US008371653B2

(12) United States Patent
Albecker, III

(10) Patent No.: US 8,371,653 B2
(45) Date of Patent: Feb. 12, 2013

(54) STRUCTURE FOR LEGLESS LEISURE CHAIRS WITH ARMRESTS

(76) Inventor: Walter Joseph Albecker, III, Chicago, IL (US)

( * ) Notice: Subject to any disclaimer, the term of this patent is extended or adjusted under 35 U.S.C. 154(b) by 0 days.

(21) Appl. No.: 12/070,254

(22) Filed: Feb. 14, 2008

(65) Prior Publication Data

US 2009/0206645 A1 Aug. 20, 2009

(51) Int. Cl.
*A47C 1/024* (2006.01)

(52) U.S. Cl. ..... 297/377

(58) Field of Classification Search ..... 297/377; 5/619, 634

See application file for complete search history.

(56) References Cited

U.S. PATENT DOCUMENTS

| | | | | |
|---|---|---|---|---|
| 2,308,410 | A | 1/1943 | Winter | |
| 2,966,205 | A | 12/1960 | Blaschko | |
| 4,660,237 | A * | 4/1987 | Brodnax | 297/377 |
| 5,825,095 | A | 10/1998 | Albecker | |
| 6,283,546 | B1 | 9/2001 | Hill | |
| D498,065 | S | 11/2004 | Potter | |

OTHER PUBLICATIONS

Kohler Pedicure Spa, K-163, http://www.us.kohler.com/onlinecatalog/newproducts_detail.jsp?section=2&aid=1176778012147, Aug. 20, 2007.

Ikea PS Brum, Children's Armchair, Ikea http://www.ikea.com/us/en/catalog/products/90101132, Dec. 8, 2008.

Rock N Fold Video Chairs, Sams Club, http://www.samsclub.com/shopping/navigate.do?dest=5&item=371994, Dec. 8, 2008.

Luna e Isola, Takuya Niimi, Designer, http://www.designspotter.com/product/2006/05/luna_e_isola.php, May 2006.

http://www.interhealth.com/n/pages-b2c/ijoy/tertiary-ht2580.html internet advertisement apparently related to US Design Patent No. D498,065 S, 2004.

http://www.slifter.com/mp/browse/piid/211107508650080.oo.html, internet ad apparently Re: US Design Patent No. D498,065 S States: "Weighs 87 lbs.", 2004.

(Continued)

*Primary Examiner* — Anthony D Barfield

(57) ABSTRACT

A number of variations of a structure for leisure chairs with armrests (4*a*) that enable a user to sit very close to floor level (SS), with side base front supports (8*f*) that extend forward further than the backrest connection means (6). The structure for the chair comprises two sides (LS and RS), a backrest (2), and means (2*p* and 6) for connecting the backrest (2) to the sides (LS and RS). Each side (LS and RS) is comprised of a first or base portion (8) having a front supporting portion (8*f*) and a rear supporting portion (8*r*); a second or armrest portion (4*a*) comprising a front armrest portion (4*af*) and a rear armrest portion (4*ar*); whereby the second or armrest portion (4*a*) is above the first portion (8), and wherein the front armrest portion (4*af*) is generally above the front supporting portion (8*f*) to make the chair stable when downward force is exerted on the front armrest portion (4*af*). Additionally, a backrest pivoting extension (2*e*) provides general lumbar support (2*u*) alignment for the backrest (2) whether the backrest (2) is in an upright or reclined position. The backrest frame sides (2*l* and 2*r*) are disclosed as straight or with a convex curve in the lower portion of the backrest sides (2*l* and 2*r*) to support an occupant's lumbar curve. A simple adjustment stop (12) is also shown for the preferred embodiment. The chair with the structure claimed is shown with a backrest cushion (2*c*), a flexibly attached cushioned seat (16), an ottoman (18), and a headrest pillow (20).

23 Claims, 9 Drawing Sheets

OTHER PUBLICATIONS
http://www.savvy-clearance.com/category/sale/home-garden/&h=300&w=250&s advertisement for iRocker 250 Gaming Chair, Oct. 17, 2009.
http://www.overstock.com/Home-Garden/iRocker-200-GamingChair/2576553/product.html?reviewsort=0&reviewpage=1#custreviews, Feb. 14, 2008.
http://www.kaboodle.com/reviews/blue-irocker-chair-100.
http://www.patiostore.com/backyard/images/Beach-Light-Easy-Low-Boy.gif&imgrefurl=http://www.patiostore.com/backyard/telescope-casual-m-1, Feb. 14, 2008.
http://upload.wikimedia.org/wikipedia/commons/6/6c/Japanese_chair_and_armrest.jpg.

* cited by examiner

STRUCTURE FOR LEGLESS LEISURE CHAIRS WITH ARMRESTS

BACKGROUND

1. Field of Invention

This invention relates to furniture, and specifically to leisure chairs which enable a user to sit very close to the ground, of the kind which could be ideally used for sitting on while at the beach, on a lawn like at an outdoor concert, or in a home for watching television, reading or working on a laptop computer.

2. Discussion of Prior Art

Over the years, numerous leisure chairs have been developed for enabling people to sit close to the floor. Examples of such chairs include:

U.S. Pat. No. 2,308,410 to Winter discloses folding leisure chairs with and without arms.

Applicant has developed a number of legless leisure chairs and parts thereof including those described in U.S. Pat. Nos. 5,425,567, 5,825,095 and 6,155,647. In U.S. Pat. No. 5,825,095 the armrests are shown approximately at the height of the obtuse angle on the backrest. If, based on preference, the armrests are lowered with respect to the backrest frame and/or the armrests are extended further to accommodate a substantial cushion on the backrest, the chair can tip forward if substantial downward force is exerted on the front of the armrests.

The present invention has two important advantages over the prior art:

1. The chair is more stable, and less likely to tip forward when someone pushes on the front of the armrests to get out of the chair.
2. The backrest pivoting extension enables the lumbar support to move lower as the chair reclines.
3. The adjustment stop provides a simple and very effective reclining mechanism.

The first advantage is especially important for legless leisure chairs having a substantial cushion on the backrest. In looking for example at the Winter chair with arms, there is reason to believe that the chair would be somewhat unstable if someone pushed on the front of the armrests to get out of the chair. The patent specifically refers on page 2 column 1 line 28 to "there is a liability of the entire frame to tip sideways." But the applicant, based on working with similar dynamics in legless leisure chairs, suspects there is also a tendency for the chair to tip forward when an occupant pushes on the front of the armrest to get out of the chair. This problem would become substantially greater if the chair had a substantial cushion on the backrest. This is because a cushion moves the body further from the most forward and base point on the backrest frame under the cushion, which would be essentially the pivot point if enough downward force were put on the front of the armrests. Use of a substantial cushion would either reduce the usable length of the armrest, or alternatively would require that the length of the armrest be increased to provide the same usable length of armrest. If the armrest length were increased, the instability of the chair would also increase, because the armrests would extend further in front of the base of the chair.

Additionally, the Winter chair, as well as other legless leisure chairs which recline at a pivot point where the base frame and backrest frame intersect, does not provide for the lumbar support (if there is one, and especially if the backrest is cushioned) to maintain the alignment with the lumbar region of a human user, when the backrest reclines from a generally upright position.

Finally, the adjustment mechanisms such as those on Winter, may be a bit complicated and clumsy to use. Though high quality, and presumably expensive, interlocking adjustment mechanisms such as in reclining car seats seem to hold up well, some legless leisure chairs seem to be made less sturdy interlocking mechanisms that seem to have a high failure rate.

Other prior art includes numerous "legless" chairs with seats of ordinary height, or nearly ordinary height, such as in US D498,065 to David Potter. Such chairs have very different dynamics from chairs such as Winter or legless leisure chairs with a lower seat, including different thigh to calf angles when someone sitting on the chair puts their feet on the floor just in front of the seat cushion. Additionally, according to advertising literature, the referenced chair weighs 87 pounds—significantly more than the legless leisure chairs such as Winter or the present invention. Further, the seat has a space under part of it, as seen from FIGS. 1, 2 and 4, has wheels under it, and the seat has a frame, which appears to be rigidly interconnected with both the armrests and backrest—when not being adjusted for reclining. Thus, the balance of a chair with a seat of ordinary, or nearly ordinary height such as about 16", is significantly different than a legless leisure chair with a seat of less than about 10". Not only is the balance different, the experience is different.

Another chair is the iRocker™, which has an open space under the seat cushions and armrests. The height of the armrests on the iRocker™ appear significantly higher than on the current invention, and again similar to chairs with seats of ordinary height, it appears that the weight is very much shifted toward the front. The position of the armrests, seat, and presumed footrest, raise questions in terms of awkwardness in terms of getting out of the chair.

The difference in dynamics in lighter chairs with seats near the floor, present special challenges with regards to balance, safety, ergonomics, convenience, and also with regards to providing optimal backrest alignment when the chair reclines. Though not all of these issues are overtly addressed in this specification, the structure of this invention dovetails with the systems described in applicant's previous patents referenced above.

OBJECTS AND ADVANTAGES OF INVENTION

Accordingly several objects and advantages of the present invention are:

(a) To provide a legless leisure chair with armrests which is more stable when a user pushes on the front of the armrests.

(b) To provide a legless leisure chair which provides more comfort or support to a user's lower back which provides more comfort to a user's lower back whether the chair is in an upright or reclining position.

(c) To provide a legless leisure chair with a simple, sturdy, and economical adjustment mechanism.

(d) To provide a structure for a leisure chair that is very comfortable for prolonged sitting.

Further objects and advantages of my invention will become apparent from a consideration of drawings and ensuing descriptions of it.

DESCRIPTION OF INVENTION

Parts List

SS Supporting Surface
HP Horizontal Plane
VP Vertical Plane
LS Left Side
RS Right Side
2 Backrest
2*l* Backrest Left Side Frame
2*r* Backrest Right Side Frame
2*t* Backrest Top
2*m* Backrest Middle Cross Member
2*b* Backrest Base
2*s* Support Sheet
2*c* Backrest Cushion
2*e* Backrest Pivoting Extension
2*p* Backrest Pivoting Means Or Lower Connection Means
2*u* Backrest Lumbar Support
2*uc* Backrest Lumbar Support Center
4 Armrest Frame
4*a* Second Or Armrest Portion
4*ar* Rear Armrest Portion
4*af* Front Armrest Portion
4*re* Armrest Extension
6 Backrest Connection Means
8 First Or Base Supporting Portion
8*f* Front Supporting Portion
8*r* Rear Supporting Portion
10 Generally Vertical Support Means
12 Adjustable Stop
12*pc* Adjustable Stop Pivoting Connection
12*l* Adjustable Stop Left Side
12*r* Adjustable Stop Right Side
12*c* Adjustable Stop Cross Member
14 Cross Member Between Sides
16 Cushioned seat
18 Ottoman
20 Headrest Pillow
22 Interlocking Adjustment Mechanism
22*l* Interlocking Mechanism Lever

FIGS. 1A-1F

Figure 1A:
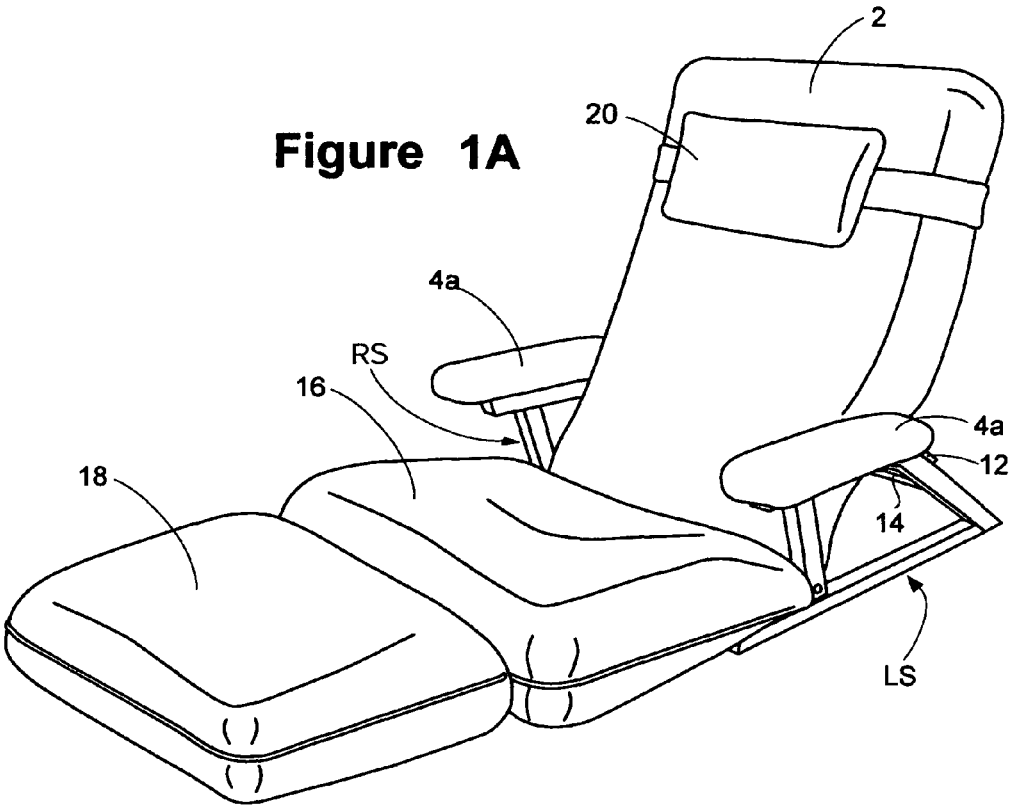
FIG. 1A is an isometric view of a chair of a typical embodiment of the present invention.
Figure 1B:
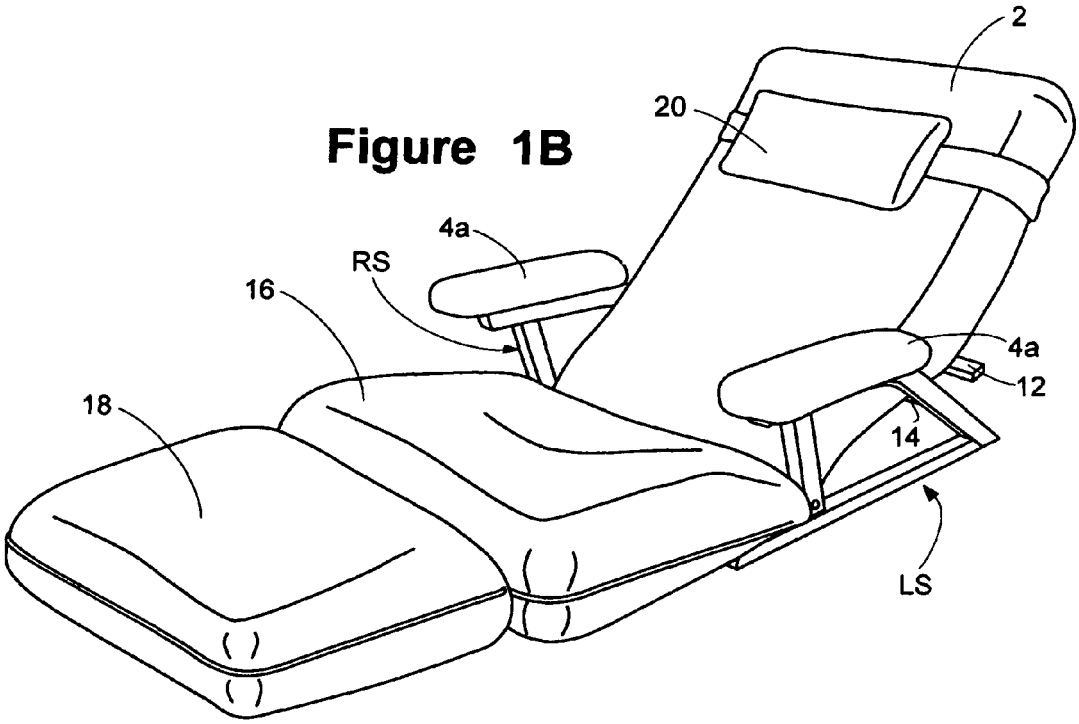
FIG. 1B is an isometric view of a chair of a typical embodiment of the present invention shown in a reclining position.

FIGS. 1A-1B show isometric views of a presently preferred embodiment of a legless leisure chair. FIGS. 1C-1F show different views the preferred embodiment of the chair structure to better illustrate certain components, concepts, and the dynamics of the chair.

FIGS. 1A-1B

As shown in FIGS. 1A-1B, the legless leisure chair has a left side LS, and a right side RS in mirror arrangement. The sides, LS and RS, are shown made of a material such as hardwood, joined with mortise and tenon joints, dowels, or another joinery method, and each side has a second or armrest portion 4*a*. As shown in greater detail in FIGS. 1C and 1D, each side, LS and RS, is comprised of an armrest frame 4, a backrest connection means 6, a first or base supporting portion 8, and a generally vertical support means. A cross member 14 is installed between the left side LS and right side RS to provide greater structural support to the frame and as a means to maintain the sides in mirror arrangement.

FIGS. 1A-1B also show additional features of a preferred embodiment of the chair, such as a cushioned backrest 2, a cushioned seat 16 attached to or near the bottom of the backrest, an ottoman 18, and a head pillow 20.

FIG. 1A shows the chair with the backrest in a generally upright position, and FIG. 1B shows the chair in a reclining position.

Sides

Figure 1C:
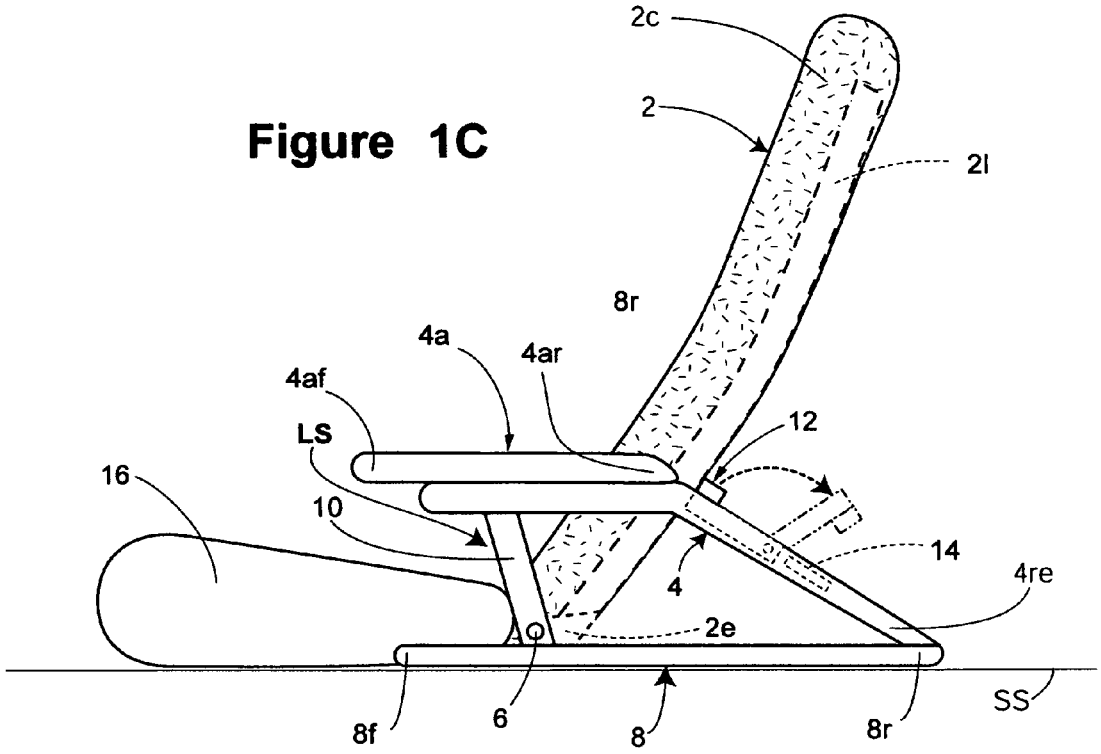
FIG. 1C is a side view of the structure of the chair shown in FIG. 1A.
Figure 1D:
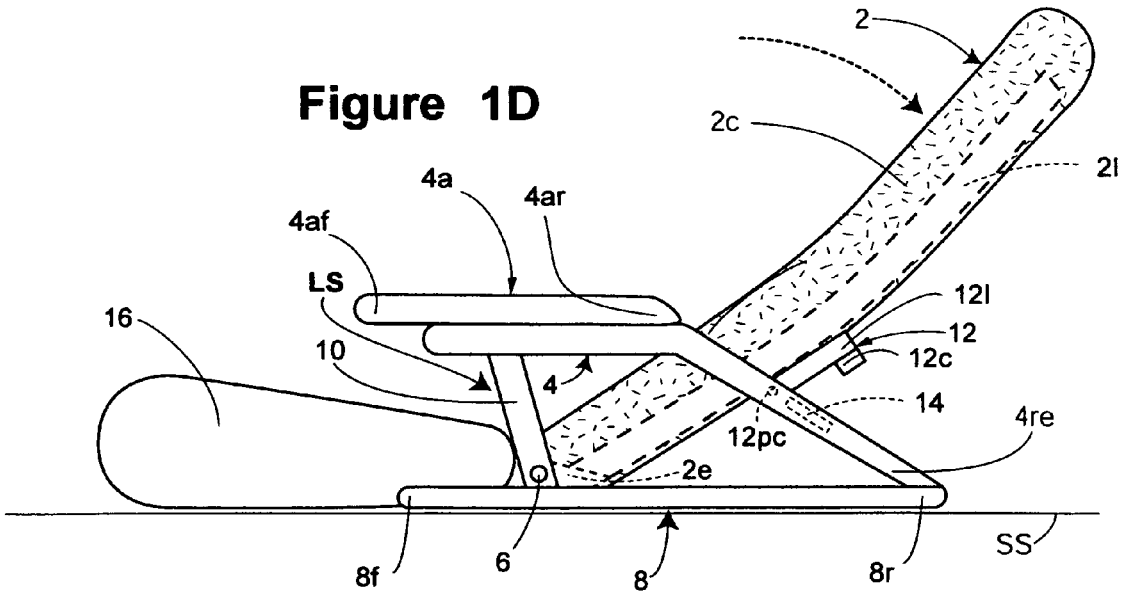
FIG. 1D is a side view of the structure of the chair shown in FIG. 1A, but shown in a reclining position.

FIGS. 1C-1D show the left side LS of the legless leisure chair shown in FIGS. 1A-1B. The right side RS is not shown in FIGS. 1C-1D, but is essentially a mirror image of the left side LS. As shown on the left side LS, there is a first portion 8, contacting a supporting surface SS, which has a front supporting portion 8*f* and a rear supporting portion 8*r*. The supporting surface SS could be a floor, deck of a boat, or a ground surface such as a lawn or sandy beach. At or near the rear supporting portion 8*r*, the first portion 8 is joined to the armrest frame 4 at or near the armrest rear extension 4*re*. The armrest frame 4 is shaped approximately as shown, so that the armrest portion 4*a* defines a generally horizontal second portion, which is vertically disposed from the first portion 8. The armrest portion 4*a* has a front armrest portion 4*af* and a rear armrest portion 4*ar*, and is positioned about 11" above the support surface SS to comfortably support the elbow and lower arm of a sitting or reclining person. The position 11" above the support surface SS refers to a measurement from the support surface SS to the top of the armrest portion 4*a*. In a preferred embodiment, the armrest portion 4*a* is made of ⅜" plywood about 4" wide and 13" long, with polyurethane foam on top, covered with fabric, and secured to the armrest frame 4 with mechanical fasteners. Though not shown, alternatively, the armrest portion 4*a* could be integral with the armrest frame 4, especially if the armrest frame 4 were made of a wider material and the armrest portion 4*a* were not padded. In the preferred embodiment, the armrest frame 4 is cut from hardwood about 1¼ thick. Between the armrest portion 4*a* and the first portion 8 is a generally vertical support means 10 for holding the second portion 4*a* vertically disposed from the first portion 8.

In the generally vertical support means 10, there is a backrest connection means 6 comprising a hole with a metal bushing inside the hole and a pin, rivet, or ready-to-assemble type screw through the bushing. The front supporting portion 8*f* is in front of the backrest connection means 6, so that the front armrest portion 4*af* is approximately directly above the front supporting portion 8*f*. The purpose of this is to prevent instability to the chair that could be caused if an occupant getting out of the chair pushed downward on the front armrest portion 4*af*. For the purposes of the claims, downward force refers to the force that most people might exert on the front armrest portion 4*af* in getting out of the chair. Between the left side LS and the right side RS, is the backrest 2. As shown in FIGS. 1C and 1D, the backrest 2 is at an acute angle relative to the support surface SS under the backrest 2. In FIG. 1C the acute angle for the backrest 2 relative to the support surface SS in the upright position is about 50° to 60°, and in FIG. 1D the acute angle for the backrest 2 relative to the support surface SS in the reclining position is about 30° to 40°. The acute angles can vary based on preferences, as some people like the backrest more upright, and others may prefer the backrest more reclined.

Cross Member

A cross member 14 made of a ¾"×3"×21½" piece of wood is attached with mortise and tenon or other joinery method to the sides LS and RS below the adjustable stop 12, and is installed to provide greater structural support to the frame. The cross member 14 is a means to maintain the left and right sides LS and RS in mirror arrangement. If mortise and tenon joints are used, the length of the wood is increased ¾" for the tenon on each side. The cross member 14 could also be positioned on the first or base supporting portion 8 at a point under the backrest.

Backrest Frame

Figure 1E:
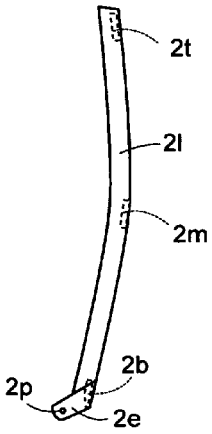
FIG. 1E is a side view of the backrest frame side for the chair shown in FIG. 1A.
Figure 1F:
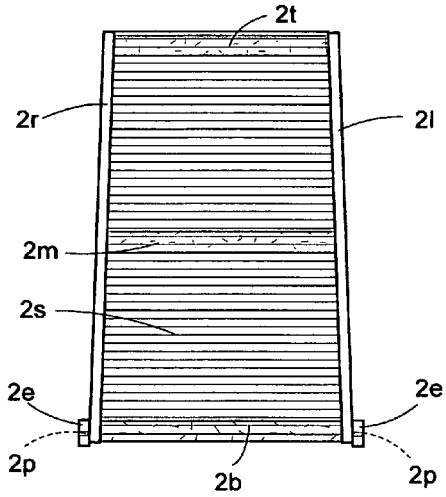
FIG. 1F is a front view of view of a backrest frame for the chair shown in FIG. 1A.
Figure 1G:
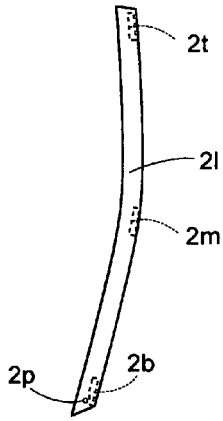
FIG. 1G is a side view of an alternate backrest frame side for the chair shown in FIG. 1A.

The backrest 2 has a frame shown in FIG. 1F which is generally rectangular with a left frame side 2*l*, a right frame side 2*r*, two pivoting extensions 2*e*, a top cross member 2*t* a middle cross member 2*m*, and a base cross member 2*b*. The portion of the backrest sides 2*l* and 2*r* between the backrest base 2*b* and the backrest middle cross member 2*m* is the lower portion of the backrest 2, while portion from the backrest middle cross member 2*m* to the backrest top 2*t* is the upper portion. Though generally rectangular, the backrest 2, in a preferred embodiment, is tapered somewhat toward the top, as shown, and thus is about 1½" wider at the bottom than the top, measured from the frame sides 2*l* and 2*r*. The distance between the frame sides 2*l* and 2*r* near the bottom is about 17½". Though technically an isosceles trapezoid, for the purposes of the claims this is generally rectangular. It is also possible to make the top 2*t*, and frame sides 2*l* and 2*r* with slight curves, as well as making the backrest somewhat concave between the frame sides 2*l* and 2*r*, and for the purposes of the claims, this would also be considered generally rectangular. A side view of the left frame side 2*l* and pivoting extension 2*e* is shown in FIGS. 1C-1E. In a preferred embodiment, the right frame side 2*r* and left frame side 2*l* are each cut to shape as shown from ¾" furniture grade plywood, and are about 1½ wide, and about 30" long. The cross members 2*t*, 2*m*, and 2*b* can be made of plywood, or another material such as ¾", thick hardwood, and positioned as shown. In a presently preferred embodiment, the base cross member 2*b* is beveled as shown in FIG. 1E so that it is relatively thin at its lowest point. The purpose of this is minimize the likelihood of any discomfort to a person sitting in the chair. This is helpful, because a significant amount of the weight of a person sitting in the chair is focused near this point, and it is near the bottom edge of the cushion 2*c* and support sheet 2*s*, which can be less supportive than portions away from the edges of the backrest 2. In FIG. 1F, between the frame sides 2*l* and 2*r*, there is a support sheet means 2*s* made of webbing, sheet webbing, wire, plywood, or another material capable of supporting the pressure of a reclining human. As shown in FIG. 1E, at the bottom of the left and right frame sides (2*l* and 2*r*) is a lower connection means 2*p*. In the preferred embodiment the bottom of left and right frame sides (2*l* and 2*r*) the lower connection means 2*p*, also referred to as a backrest pivoting means, protrudes forward with a backrest pivoting extension 2*e*. The effect of the backrest pivoting extension 2*e* is to move the backrest pivoting means about 1½" from the center of the backrest frame side 2*l* and 2*r* width—where the pivoting means 2*p* would logically be put if the backrest pivoting extension 2*e* were not provided, as shown in FIG. 1G. The backrest frame can be made without the extension as shown in FIG. 1G, but this is not presently preferred. The advantage of the extension 2*e* is illustrated in FIGS. 1J-1M, and discussed under Operation of Invention, Reclining—Pivoting Extension. In the preferred embodiment, the backrest pivoting extension 2*e* is made from ¾" furniture grade plywood, and is glued and pinned with brads to the backrest side frame side 2*l* and 2*r* on the side opposite the base cross member 2*b*. As shown in FIG. 1F, though the frame sides 2*l* and 2*r* are not parallel, provision is made to make the pivoting extensions 2*e* parallel through machining either the lowest part of the frame sides 2*l* and 2*r* or the pivoting extensions 2*e*. The ¾" thickness of the backrest pivoting extension 2*e* causes the backrest pivoting means 2*p* to be closer to the backrest connection means 6 on the sides LS and RS, which provides greater stability to the pivoting means 2*p*.

Backrest Pivoting Means

As shown in FIG. 1E, on the backrest pivoting extension 2*e* there is a hole 2*p* filled with a T-nut. A ready-to-assemble screw, as part of the backrest connection means 6 on the left side LS shown in FIGS. 1C and 1D is screwed into the T-nut. To prevent the screw from working its way out with the back and forth reclining motions shown in FIGS. 1B and 1D, various means could be used, such as the threads of the screw can be coated with a seizing compound, a crimp could be used in the T-nut, and/or a locking nut with a nylon insert could be used. Alternately, other mechanical fasteners such as rivets, speed nuts, cotter pins, clips, etc. could be used in place of a T-nut and screw. On the preferred embodiment, between the pivoting extension 2*e* and the generally vertical support means 10 on the sides, there is a nylon bushing to maintain a small space for clearance between the sides LS and RS and the pivoting extensions 2*e* on the respective left and right backrest frame sides 2*l* and 2*r*, and also to reduce friction in the pivoting movement when the chair reclines as shown in FIG. 1D. The ready-to-assemble screw at the backrest connection means 6 goes through the nylon bushing.

Adjustable Stop

Figure 1H:
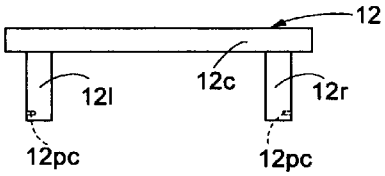
FIG. 1H is a rear view of the adjustable stop.

As illustrated in FIGS. 1C and 1D, behind the backrest 2, there is an adjustable stop 12 between the rear armrest portion 4*ar* and the rear supporting portion 8*r*. In FIG. 1C, the stop 12 is shown in the upright position, with the backrest 2 leaning against it. In FIG. 1D, the stop 12 is shown having been rotated to the lower or reclined position. As illustrated in FIG. 1H, the adjustable stop 12 has a cross member 12*c*, which is attached to adjustable stop sides 12*l* and 12*r*. The adjustable stop cross member 12*c* is made of hardwood that is about ¾" thick, 1½" high, and 24½" across. The outside measurement from left side LS to the right side RS is 24", so the adjustable stop cross member 12*c* extends about ¼" on each side to make it easy to move for adjustments. The adjustable stop sides are made of hardwood that is about 1" thick, 1½" wide, and 5¼" long. As shown in FIG. 1D, the adjustable stop side 12*l* is pivotally attached to the armrest extension 4*re* with a rotary hinge 12*pc* or another pivoting means. The adjustable stop side 12*r* is similarly attached to the right side RS. The adjustable stop sides 12*l* and 12*r* are wide enough to contact and support the backrest left and right frame sides 2*l* and 2*r* when the backrest 2 is in the reclined position. When the backrest 2 is in the upright position, the cross member 12*c* contacts and supports the backrest left and right frame sides 2*l* and 2*r*. To prevent excess wear at the points where the adjustable stop 12 contacts the backrest 2, the preferred embodiment has a wear protector such as a nylon floor glide used on the bottom of furniture attached to the underside of the left and right frame sides 2*l* and 2*r*, or a fabric patch sewn to the upholstery covering the frame at the point where the stop 12 contacts the backrest 2.

Cushions and Upholstery

FIGS. 1A-1B show the structure of a preferred embodiment upholstered with cushions. The cushioned seat 16 in the preferred embodiment is made of a cushioning material such as polyurethane foam. The cushioned seat could however be made in different manners such as with a frame with support sheet such as webbing or springs or other methods which are or will be commonly used in various upholstered chairs. Near the backrest 2, the cushioned seat is about 4" thick and is shaped with approximately a 15° incline, thus is about 8½" at its thickest point, and its length measured parallel to the sides LS and RS, is about 17½". For the purposes of the claims, the term "legless leisure chair" refers to chairs where the seat cushion, for a chair designed for an adult, has an average height of 10" high or less measured from the support surface. The cushioned seat 16 is attached to the backrest 2, and particularly to the backrest base 2*b* shown in FIGS. 1E and 1F. Alternatively, the cushioned seat could be attached to or between the sides LS and RS, especially if there were a cross member near the backrest base 2*b*. In a preferred embodiment, the cushioned seat 16 has an upholstered fabric cover with a flap extending toward the backrest base 2*b*. The flap is stapled to the backrest base 2*b* to prevent the cushioned seat 16 from moving away from the backrest 2. The bottom of the cushioned seat 16 is generally resting directly on the support surface SS, and is primarily supported by the supporting surface SS, and most of the underside of the cushioned seat 16 is supported by the support surface. The purpose of the upholstered flap attached to the backrest 2 is primarily to prevent the cushioned seat 16 from pulling away from the backrest 2. The attachment of the cushioned seat 16 to the backrest bottom 2*b* is flexible, and thus the cushioned seat remains on the support surface in generally the same position, regardless of whether the backrest is in an upright or reclining position. The seat cushion 16 is in front of the backrest 2, and between the front supporting portion 8*f* on the left and right sides LS and RS. The ottoman 18 is approximately 8" thick near the cushioned seat 16, and gets thinner away from the cushioned seat 16 with approximately a 7° slope. Also shown is a headrest pillow 20.

Operation of Invention

Chair Stability

One of the key advantages of the present invention is that if someone sitting on the chair pushes downward on the front of the armrest 4*af* as they are getting in or out of the chair, the chair will not tip forward. Tipping forward refers to the front of the armrest 4*af* moving generally downward, the backrest 2, especially the backrest top 2*t*, moving generally forward, and the rear supporting portion 8*r* moving generally upward, such that in FIGS. 1C and 1D the armrest front 4*af*, backrest 2, and rear supporting portion 8*r* would all be moving in a counterclockwise direction with the tipping point at the front supporting portion 8*f*. The reason the present invention is stable with regards to tipping, is that the front supporting portion 8*f* is far enough forward that the amount of force necessary to tip the at this point, exceeds the amount of force that most people who would use the chair could exert. To illustrate the dynamic in the negative, if the front supporting portion 8*f* was near the backrest connection means 6, it would take far less downward force for the chair to tip, and thus the chair would be much more susceptible to tipping if a user pushed on the front of the armrest 4*af*. The further the front supporting portion 8*f* is away from the backrest connection means 6, the greater the downward force on the front of the armrest 4*af* necessary to tip the chair, assuming other elements, including the front of the armrest 4*af* position, are constant. In the preferred embodiment, shown in FIGS. 1A-1F and 1H-1I, the front supporting portion 8*f* is almost as far forward from the vertical plane VP centered through the backrest connection means 6 shown in FIG. 1I, as is the front of the armrest 4*af*. For stability, it is not necessary that the front supporting portion 8*f* be at least the same distance from the vertical plane VP as the front of the armrest portion 4*af*. However, for good stability, in the preferred embodiment, the horizontal distance from the vertical plane VP of the front armrest portion 4*af* should not be more than about one or two inches more than horizontal distance from the vertical plane VP for the front supporting portion 8*f*. It is, of course, possible to make the have the front supporting portion 8*f* extend further than the front armrest portion 4*af*. However, there is little gained with regards to stability. There is some variability as to the precise horizontal distance from the vertical plane VP for the front supporting portion 8*f*, based on certain variables such as the weight of the weight of the chair behind the vertical plane, etc. The heavier the chair is behind the vertical plane, the less the front supporting portion would have to extend from the vertical plane VP, and the reverse would also be true. Further, the rear supporting portion 8*r* prevents the chair from tipping backward when the weight of someone is leaning against the backrest—especially in the reclined position.

Relationship of the Elements

Figure 1I:
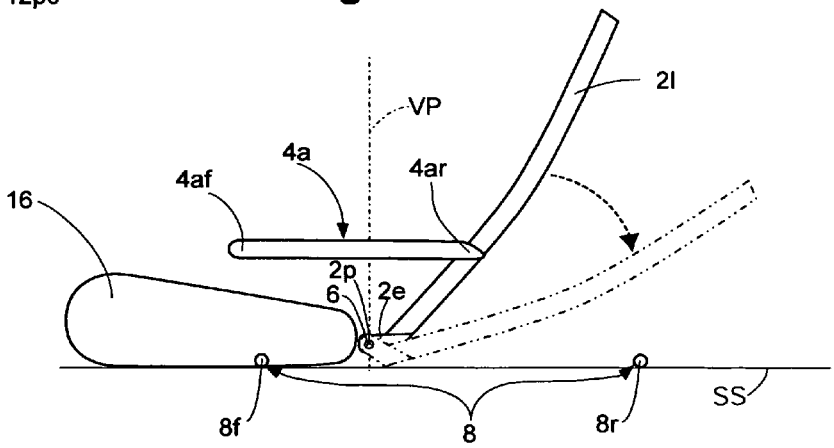
FIG. 1I is a side view to show the essence of the invention using the elements shown in FIG. 1A-1F.

FIG. 1I is a side view showing the key elements of the present invention, and the relative positions of those elements. These key elements represent the essence of the invention, and as is shown in FIGS. 2-8, these elements can be applied to various embodiments. In the presently preferred embodiment, the dimensions of armrest front portion 4*af* is about 7" in front of the vertical plane VP, the armrest rear portion 4*ar* is about 7" to the rear of the vertical plane VP, the front supporting portion 8*f* is about 6¼" in front of the vertical plane VP, and the rear supporting portion 8*r* is about 17½" to the rear of the vertical plane VP. The front of the seat cushion 16 is about 19½" from the vertical plane. For the purposes of the claims, all references to distances from the backrest connection means 6 refer to a measurement from the vertical plane above the backrest connection means 6 as shown in FIGS. 1I and 2E. All dimensions relative to the vertical plane are horizontal distances, with horizontal referring to parallel to the support surface SS. References to in front of the backrest connection 6 refer to a horizontal direction from the vertical plane VP toward the front armrest portion 4*af* or the front supporting portion 8*f*. References to behind or to the rear of the backrest connection 6 refer to a horizontal direction from the vertical plane VP toward the rear armrest portion 4*ar* or the rear supporting portion 8*r*. The approximate dimensions referred to in this specification generally refer to the measurements of the furthest point of the element being measured, except the pivot point measurements such as 6 and 2*p* refer to a measurement from the center of the pivot point. The vertical plane VP is centered on the backrest connection means 6, thus the backrest connection means 6 is at an intermediate point between the front supporting portion 8*f* and the rear supporting portion 8*r*. The backrest connection means 6 in the preferred embodiment is about 1⅝" above the support surface SS, and is thus somewhat above the support surface SS and considerably lower than the generally horizontal second or armrest portion 4*a*. These numbers and proportions can be varied somewhat, and the fractional inches should not be interpreted as limiting variation, but simply actual measurements.

Reclining—Pivoting Extension

A person wishing to sit on the chair would rest their buttocks on the cushioned seat 16, and lean their back against the backrest 2. As shown in FIGS. 1C-1F and 1I, the lower portion of backrest side frame sides 2*r* and 2*l* have a pivoting extension 2*e* as shown. The pivoting extension 2*e* protrudes forward from the backrest frame side 2*l* at approximately a 135° angle, as shown. The angle the pivoting extension 2*e* protrudes forward is measured from the back of the backrest frame side 2*l*, near the pivoting extension 2*e*. On the backrest frame side 2*l* in FIG. 1C, the front of the backrest frame side contacts the backrest cushion 2*c*, and the back of the backrest frame side 2*l* faces the opposite way, toward the rear supporting portion 8*r*. The pivoting extension 2*e* is shaped and positioned in a manner that enables the bottom of the backrest 2 to adjust downward as the degree of inclination of the acute angle between the support surface SS and the backrest 2 is decreased when the chair is adjusted to a reclining position.

Figure 1J:
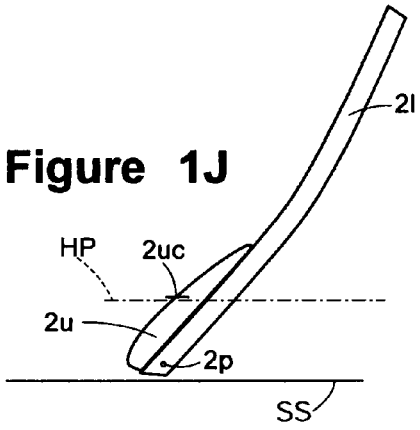
FIG. 1J is a side view of the backrest frame in FIG. 1G, with no pivoting extension, but with an internal lumbar support, shown relative to a horizontal plane.
Figure 1K:
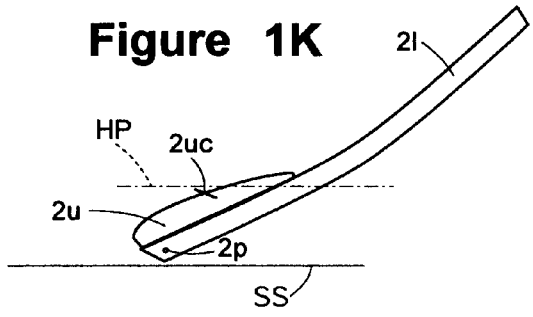
FIG. 1K is a side view of the backrest frame in FIG. 1J, but shown in the reclining position to indicate the minimal change of the lumbar support's position relative to the horizontal plane.
Figure 1L:
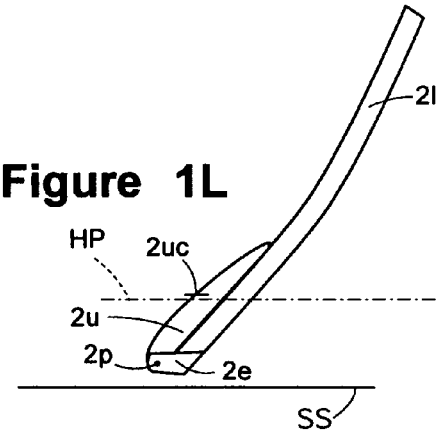
FIG. 1L is a side view of the backrest frame in FIGS. 1A-1F, with a pivoting extension, and with an internal lumbar support, shown relative to a horizontal plane.
Figure 1M:
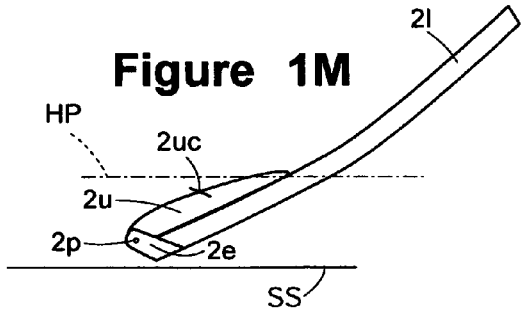
FIG. 1M is a side view of the backrest frame in FIG. 1L, but shown in the reclining position to show how the lumbar support's position change relative to the horizontal plane is significantly greater than that shown for the backrest without the pivoting extension in FIG. 1K.

The purpose of lowering the bottom of the backrest 2 in such a manner is that it helps maintain proper lumbar support 2*u* alignment. FIGS. 1J-1M show how a backrest lumbar support center 2*uc* moves relative to a horizontal plane HP as a backrest frame 2*l* reclines. In FIG. 1J a backrest frame side 2*l* without a pivoting extension is shown in the upright position with a lumbar support 2*u*. In the drawing 2*uc* is the center of the lumbar support, and the center 2*uc* is shown slightly above a horizontal plane HP. FIG. 1K shows what happens when the backrest frame side 2*l* is pivoted with the backrest pivoting means 2*p* to a reclining position. In the reclining position, the lumbar support center 2*uc* is a little bit below the horizontal plane HP. In FIG. 1L the backrest frame side 2*l* is shown with the pivoting extension 2*e*. In this drawing the backrest frame side 2*l* is in the upright position and the lumbar support center 2*u* is shown slightly above the horizontal plane HP similar to FIG. 1J. FIG. 1M shows what happens when the backrest frame side 2*l* with the pivoting extension 2*e* is reclined using the backrest pivoting means 2*p*. In this drawing, the lumbar support center 2*uc* is significantly further from the horizontal plane HP, than for the backrest frame side 2*l* without the pivoting extension 2*e*. The difference in the position of the lumbar support center 2*u* as compared with FIG. 1K is not only significantly lower when measured vertically, more importantly it is more significantly lower when measured from the lumbar support center 2*uc* to the point where the lumbar support 2*u* intersects with the horizontal plane HP. This reflects a closer alignment with the lumbar curve on the back of someone sitting on the chair as the backrest 2 reclines. One of the critical benefits of the backrest pivoting extension 2*e* is that it enables the backrest 2 to lower the lumbar support 2*u* without breaking the plane of the support surface SS as the bottom of the backrest goes down. Thus, the backrest reclines freely without contacting the support surface. This is accomplished by first raising the backrest connection means 6 to about 1⅝" above the support surface SS. In FIGS. 1J and 1K, the backrest pivoting means 2*p* for the backrest without the pivoting extension 2*e*, which would be the same height above the support surface SS as the backrest connection means 6, only needs to be about ⅞" above the support surface SS to avoid having the bottom of the backrest frame side 2*l* from contacting the support surface SS. The backrest pivoting extension 2*e* of the shape shown has proven effective for generally maintaining the lumbar support 2*u* alignment without the backrest 2 contacting the support surface SS. Further, not only is the lumbar support in better alignment, but the entire backrest is in better alignment with a user's spine and head. The backrest pivoting extension 2*e* is about 4" at its longest point, and about 1½" wide at its widest point, and shaped as drawn. The backrest pivoting extension 2*e* moves the backrest pivoting means 2*p* forward about 1⅜" from where the pivot means 2*p* would be as shown in FIGS. 1J and 1K. As shown in FIG. 1I, the backrest frame side 2*l* is shown in the upright position with a solid line, and in the reclining position in phantom lines. As shown, the backrest pivoting means 2*p* stays in the same position, but the backrest pivoting extension 2*e* causes the entire backrest to move down slightly as the angle of inclination decreases. This can be seen by noting how the lowest point on the rear of the backrest frame side 2*l* moves toward the support surface SS when the angle of inclination decreases. The pivoting extension 2*e* and the pivoting means 2*p* are positioned and dimensioned to stay within the thickness of the backrest cushion 2*c* shown in FIGS. 1C-1D, and also to allow the backrest 2 to recline with the lowest part of the backrest 2 coming as close to the support surface SS as possible, without interfering with the reclining function of the chair. In the preferred embodiment, the total thickness of the cushioned backrest 2 is about 5".

Reclining—Adjustable Stop

The adjustable stop 12 is a pivoting stop which the backrest 2 leans against. For the backrest 2 to be in the upright position, the cross member 12*c* of the pivoting stop contacts the armrest frame 4 near the rear armrest portion 4*ar* as shown in FIG. 1C. If the cross member 12*c* of the pivoting stop 12 is rotated about 100° away from the armrest portion 4, as shown in FIG. 1C, the backrest 2 can recline. It is necessary to move the backrest 2 forward slightly to release the pressure on the pivoting stop 12, and then a user can just reach behind and push the pivoting stop cross member 12*c* toward the rear of the chair. The cross member 14 prevents the pivoting stop 12 from going substantially further than the approximate reclining position. Next, the backrest 2 is slowly lowered until the backrest sides 2*l* and 2*r* contact the pivoting stop 12. This action will cause the pivoting stop to approximately line up with backrest sides 2*l* and 2*r*, as shown in FIG. 1D. To go from the reclining position to the upright position, the steps are reversed. The adjustment stop 12 provides a very simple and easy way to adjust the acute angle of incline on the backrest 2.

FIGS. 2A-2G

Figure 2A:
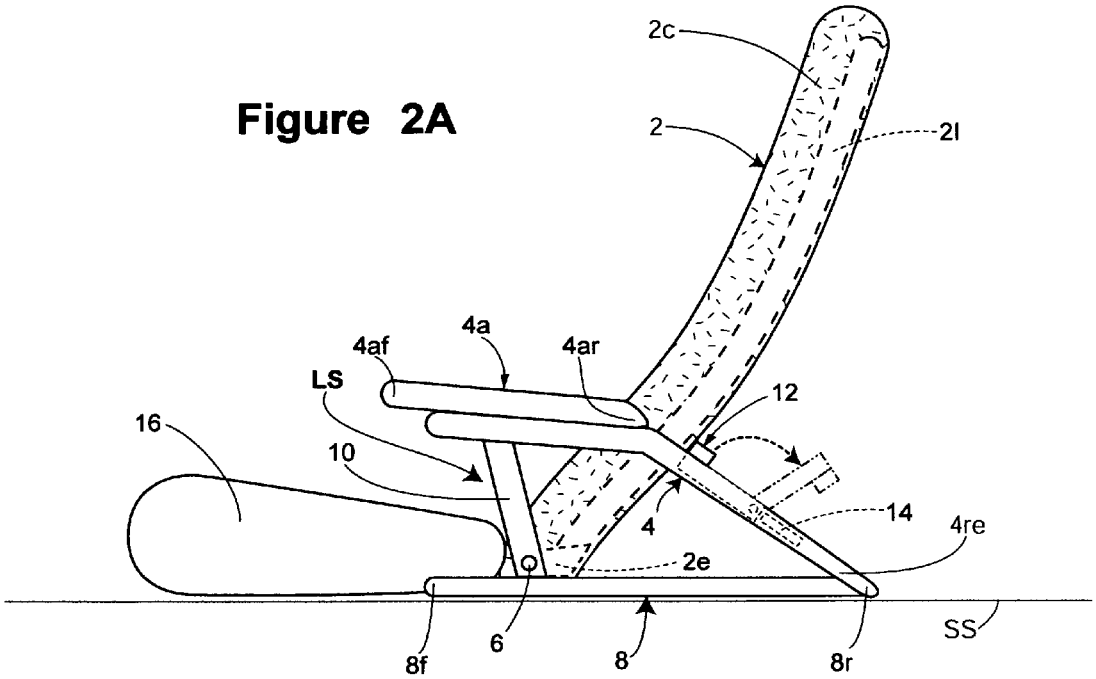
FIG. 2A is a side view of a chair structure similar to the one shown in FIGS. 1A and 1B, with an armrest that angles up slightly, and also that has a curve in the backrest frame to support a user's lumbar curve.

FIG. 2A is a side view of a chair frame similar to the embodiment shown in FIGS. 1A and 1B, with an armrests that angle up slightly, and also with a curve in the backrest frame sides 2*l* and 2*r* to support a user's lumbar curve. The curve in the lower portion of the backrest frame sides 2*l* and 2*r* provides an economical way of providing a lumbar support. The slight incline in the armrest 4*a* can be preferred by some people for comfort. In a preferred embodiment, the distance from the supporting surface SS to the armrest front 4*af* is about 12" and the distance from the supporting surface SS to the armrest rear 4*ar* is about 11". From the standpoint of the claims, a moderate incline of up to about 15° in the armrest portion 4*a* is considered generally horizontal.

Figure 2B:
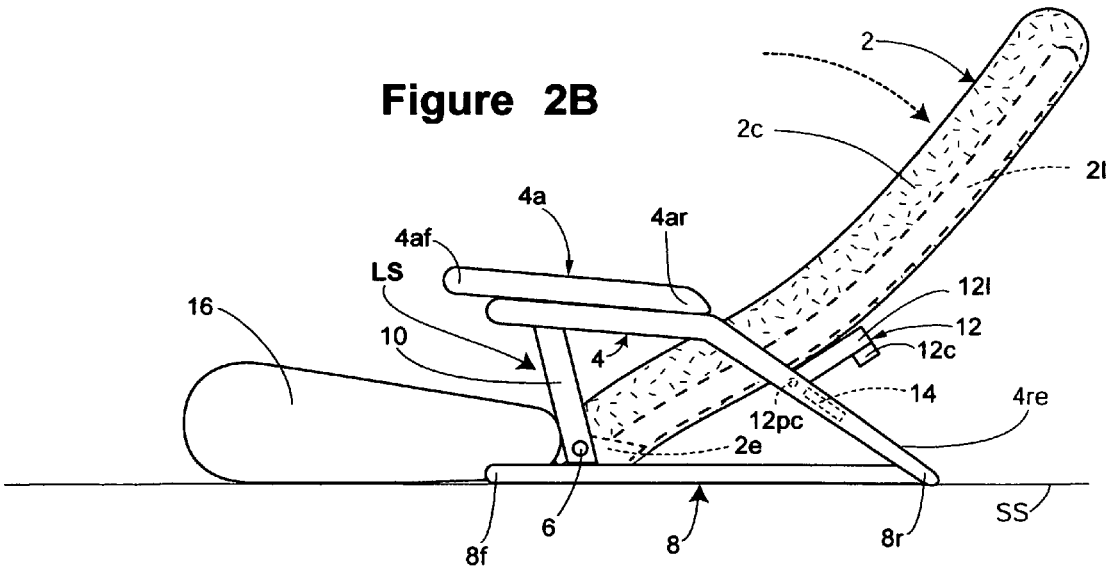
FIG. 2B is a side view of the chair structure shown in FIG. 2A shown in a reclining position.

FIG. 2B is a side view of a chair frame shown in FIG. 2A shown in a reclining position.

Figure 2C:
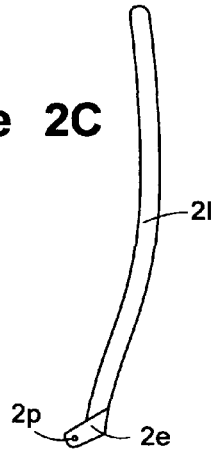
FIG. 2C is a side view of the backrest frame side for the chair shown in FIGS. 2A & 2B.

FIG. 2C is a side view of the backrest frame side 2*l* for the chair shown in FIGS. 2A & 2B.

Figure 2D:
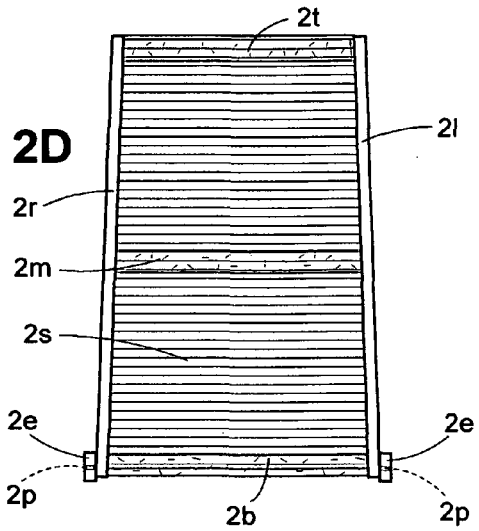
FIG. 2D is a front view of view of a backrest frame for the chair shown in FIG. 2A.
Figure 2E:
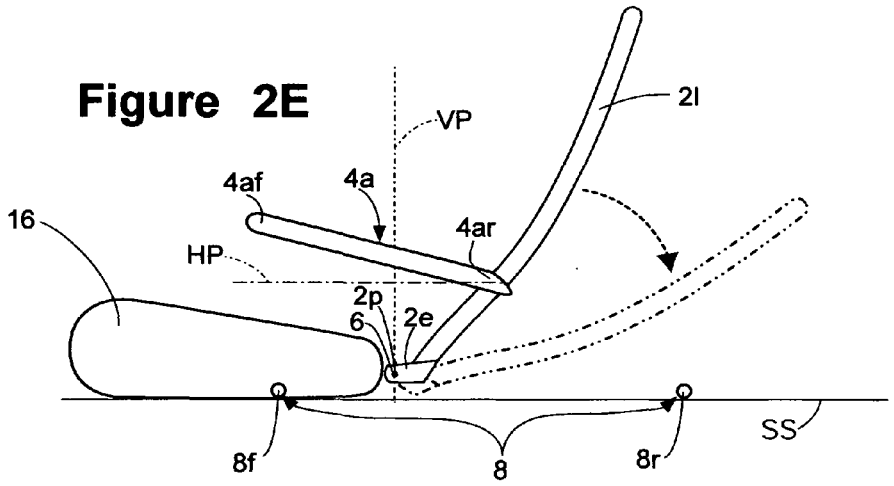
FIG. 2E is a side view to show the essence of the invention using the elements shown in FIG. 2A-2D.

FIG. 2D is a front view of view of a backrest frame for the chair shown in FIGS. 2A-2B.

FIG. 2E is a side view to show the essence of the invention using the elements shown in FIG. 2A-2D. This is comparable to FIG. 1I, but with the changes identified for FIGS. 2A-2B.

Figure 2F:
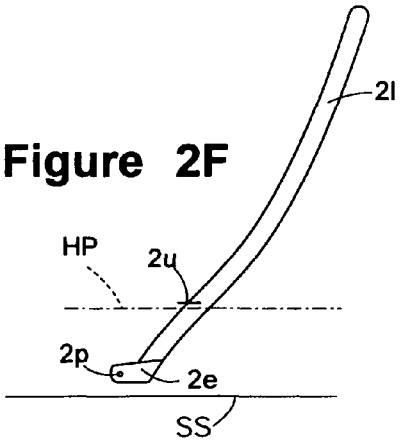
FIG. 2F is a side view of the backrest frame in FIG. 2A, with a pivoting extension, and with a lumbar support curve on the backrest frame side, shown relative to a horizontal plane.

FIG. 2F is a side view of the backrest frame in FIG. 2A, with a pivoting extension 2*e*, showing the lumbar support center 2*uc* on the backrest frame side 2*l* relative to a horizontal plane HP.

Figure 2G:
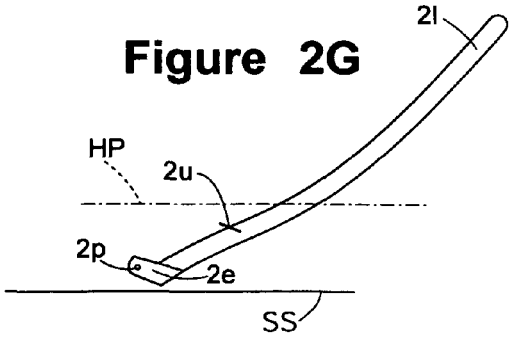
FIG. 2G is a side view of the backrest frame in FIG. 2A, but shown in the reclining position to the show how the lumbar support's position change relative to the horizontal plane is significantly greater than that shown for a backrest without the pivoting extension like shown in FIG. 1K.

FIG. 2G is a side view of the backrest frame with the pivoting extension 2*e* in FIG. 2A, but shown in the reclining position to the show how the lumbar support center 2*uc* is significantly lower than the horizontal plane. Similar to FIG. 1M, the difference in the position of the lumbar support center 2*u* as compared with FIG. 1K is not only significantly lower when measured vertically, more importantly it is more significantly lower when measured from the lumbar support center 2*uc* on the lower portion of the side frame 2*l* to the point where the lumbar support curve intersects with the horizontal plane HP. This reflects a closer alignment with the lumbar curve on the back of someone sitting on the chair as the backrest 2 reclines. This was described under Operation of Invention—Reclining—Pivoting Extension above.

Figure 3:
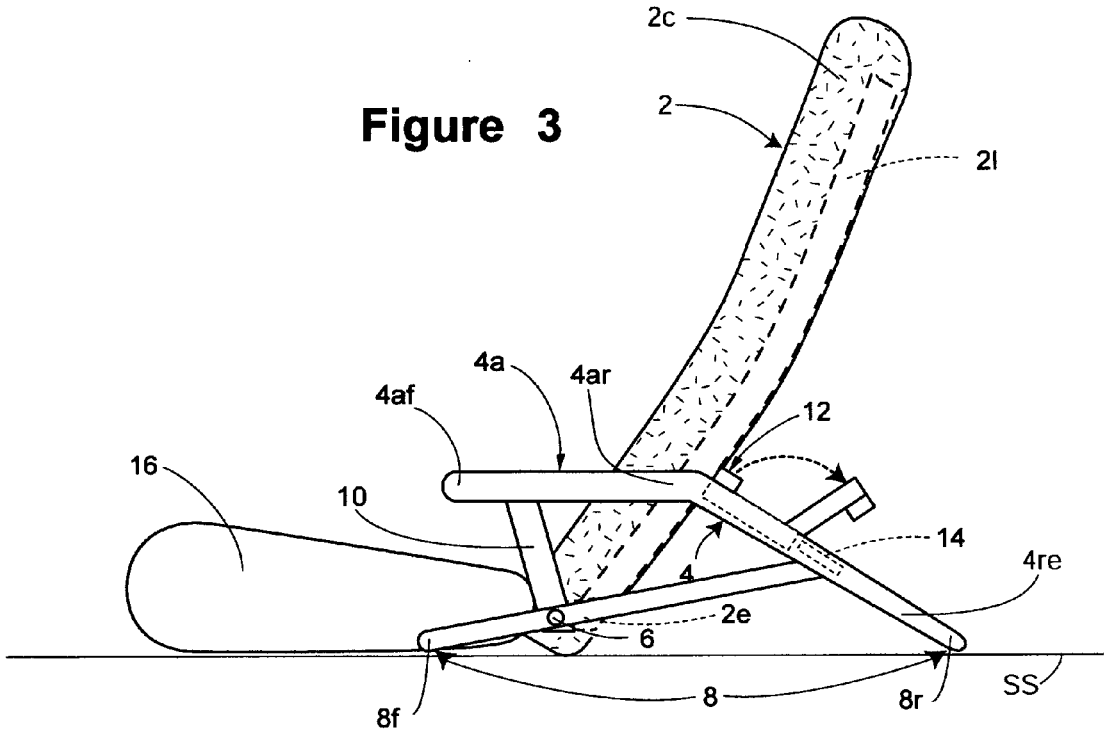
FIG. 3 is a side view of a variation of the structure shown in shown in FIG. 1, but with the first supporting portion having a space along the support surface between the front supporting portion and the rear supporting portion.

FIG. 3 is a side view of a variation of the frame shown in shown in FIG. 1, but where the first supporting portion 8 does not continuously contact the supporting surface SS between the front supporting portion 8*f* and the rear supporting portion 8*r*. As shown in FIG. 1I, the essence of this invention does not require that the first or base supporting portion 8 be continuous along the supporting surface SS. In this embodiment, the backrest connection means 6 is in the same member as the front supporting portion 8*f*, instead of the in the generally vertical means 10 for holding the armrest portion 4*a* vertically disposed from the first portion 8. The essence of the invention described in FIG. 1I applies to this embodiment. As illustrated in FIG. 3, the first portion 8, comprised of the front supporting portion 8*f* and the rear supporting portion 8*r*, does not need to be integral and continuous along the supporting surface SS. Additionally, FIGS. 3-5 each have an armrest portion 4*a*, which is not upholstered. Though an upholstered armrest could be used on these embodiments, just as the other embodiments could have armrests which are not upholstered, FIGS. 3-5 assume that the unpadded armrests are made of a wood which is about 4" wide for the armrest portion 4*a*.

Figure 4:
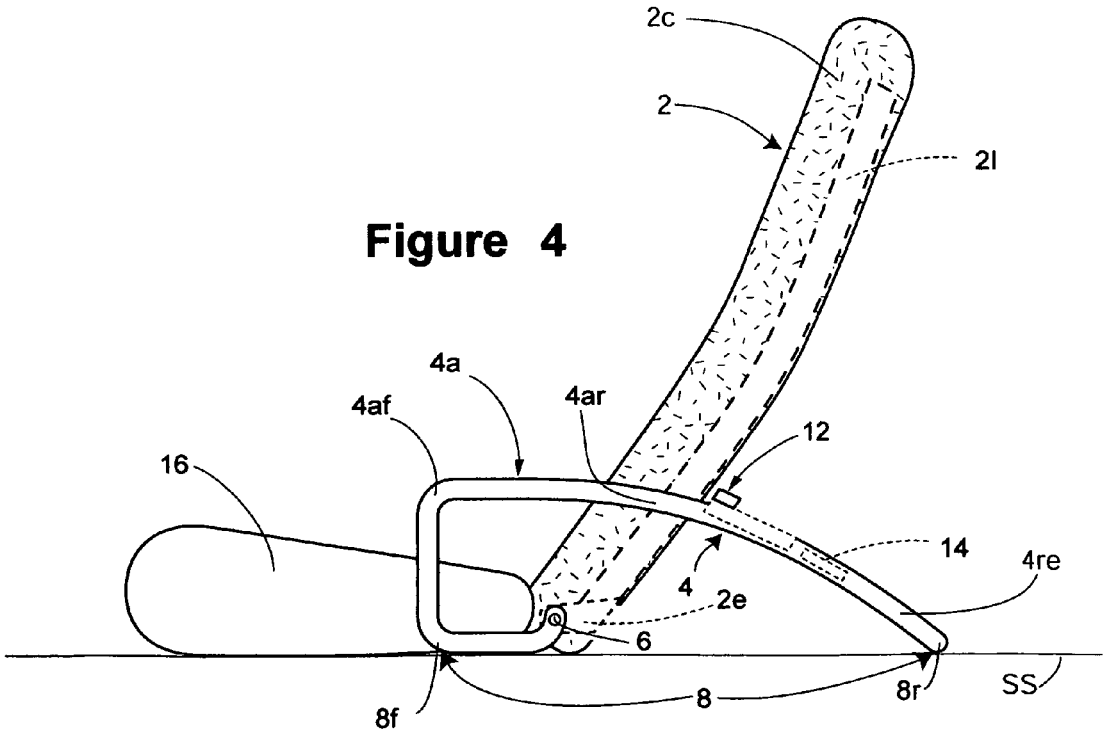
FIG. 4 is a side view of another variation of the structure shown in shown in FIG. 1, but with the base first supporting portion having a space along the support surface between the front supporting portion and the rear supporting portion.

FIG. 4 is a side view of another variation of the frame shown in shown in FIG. 1, but where the first supporting portion 8 does not continuously contact the supporting surface SS between the front supporting portion 8*f* and the rear supporting portion 8*r*. The essence of the invention described in FIG. 1I applies to this embodiment. As illustrated in FIG. 3, the first portion 8, comprised of the front supporting portion 8*f* and the rear supporting portion 8*r*, does not need to be integral and continuous along the supporting surface SS. The sides for this embodiment could be made of a shaped laminated wood, and do not need a generally vertical support means 10 as shown on other embodiments. The construction and design, as shown, inherently provides and is a means for holding the second portion or armrest portion 4*a* vertically disposed from the first portion 8. The armrest portion 4*a* is integral with the armrest frame 4, and is an example of an armrest which is not padded.

Figure 5:
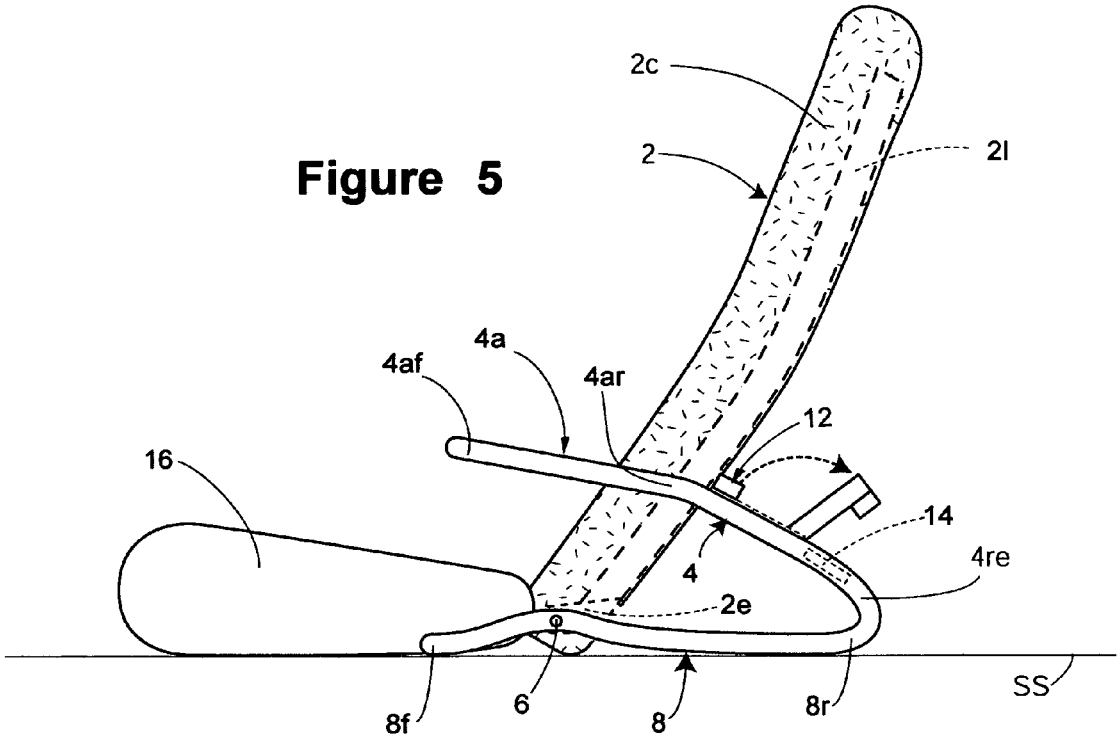
FIG. 5 is a side view of another variation of the structure shown in shown in FIG. 1, but without a vertical support directly below the armrest portion.

FIG. 5 is a side view of another variation of the frame shown in FIG. 1, but without a generally vertical support directly below the armrest portion 4*a*. The sides for this embodiment could be made of a shaped laminated wood, and do not need a generally vertical support means 10 as shown on other embodiments. The construction and design, as shown, inherently provides and is a means for holding the second portion or armrest portion 4*a* vertically disposed from the first portion 8.

The first supporting portion 8 is raised at the point of the backrest connection means 6 to enable the chair to recline without the backrest pivoting extension 2*e* causing the bottom of backrest to rub against the supporting surface SS, as described above under Operation of Invention—Reclining—Pivoting Extension.

Figure 6:
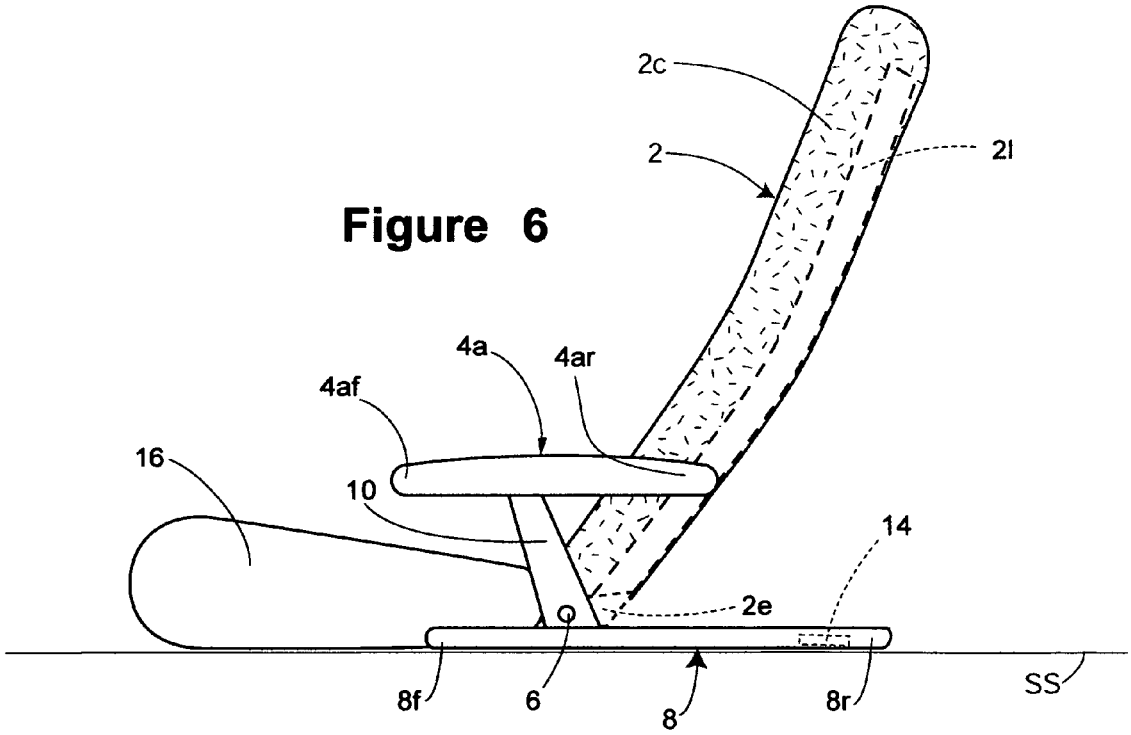
FIG. 6 is a side view of a variation of the structure shown in shown in FIG. 1, but with a void between the rear armrest portion and the rear supporting portion and also using an interlocking adjustment mechanism.

FIG. 6 is a side view of a variation of the frame shown in shown in FIG. 1, but with a void between the rear armrest portion and the rear supporting portion and also using an interlocking adjustment mechanism as opposed to the movable stop 12 shown in many of the other FIG.s. An interlocking adjustment would be like an adjusting system in a reclining seat of an automobile. The structure shown in this and other embodiments, such as in FIGS. 7-8, could be made with a variety of adjustment or reclining mechanisms known or to be known in the industry related to chairs. Adjustment mechanisms could be from the primitive such as shown in the Winter patent, to ratcheting or like on cars, to more complicated power adjustments mechanisms.

Figure 7:
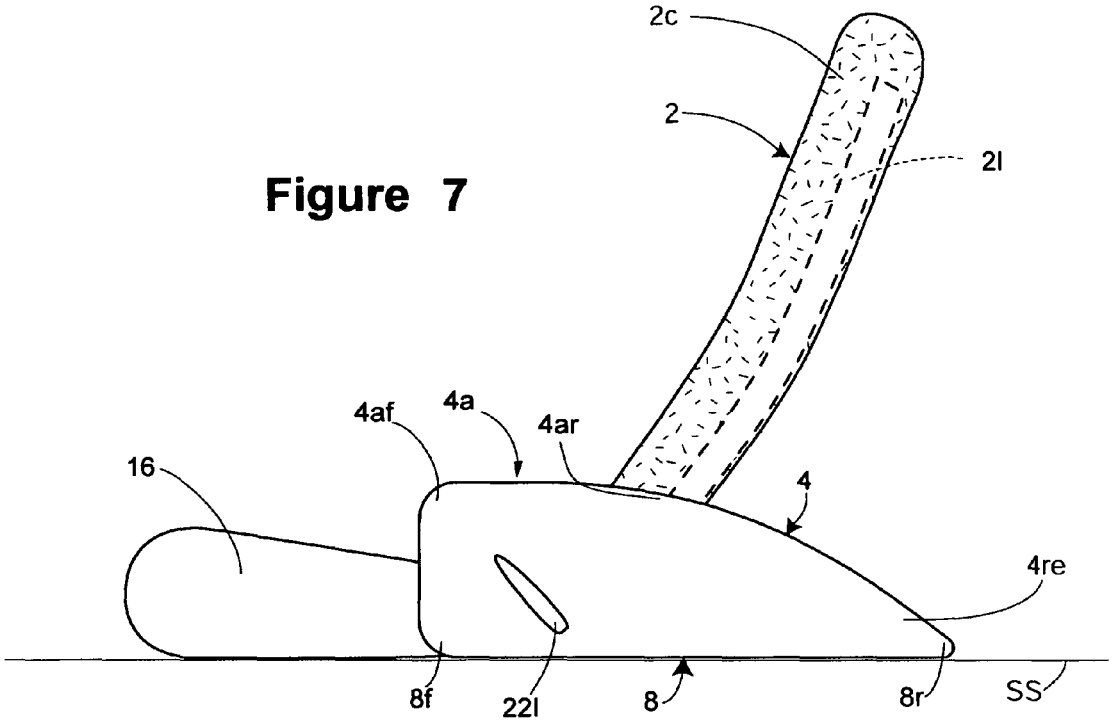
FIG. 7 is a side view of a variation of the structure shown in shown in FIG. 1, but with the sides upholstered.

FIG. 7 is a side view of a variation of the frame shown in shown in FIG. 1, but with the sides upholstered like many conventional chairs. Though an adjustable stop such as shown in FIG. 1H could be used on this style chair, it is shown with an adjustment mechanism similar to that used for a reclining seat in a car, and with an adjustment handle 22*l*. Though described with an adjustment mechanism similar to that used for a car, there are a number of applications for adjusting backrests which are known or will be known that could be used here.

Figure 8:
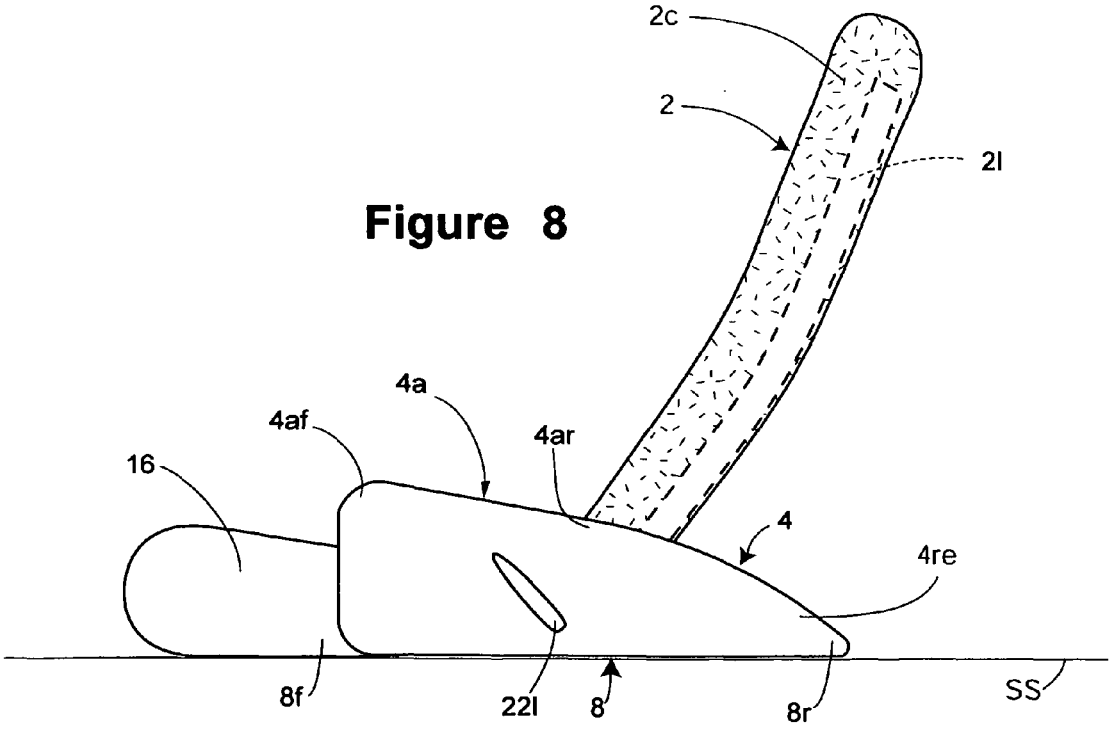
FIG. 8 is a side view of a variation of the structure shown in shown in FIG. 7 with the sides upholstered, but shown with the rear supporting portion closer to the backrest connection means, the front supporting portion moved forward, and also with the armrest angled slightly upward.

FIG. 8 is a side view of a variation of the frame shown in shown in FIG. 7 with the sides upholstered, but shown with the rear supporting portion 8*r* closer to the adjustment handle 22*l*, which is at approximately the same point as the backrest connection means. Additionally, the front supporting portion 8*f* is shown extending forward from the adjustment handle 221 further than the embodiment in FIG. 7 above, and also the armrest 4*a* is angled slightly upward.

CONCLUSIONS RAMIFICATIONS AND SCOPE OF THE INVENTION

Thus the reader will that this invention can be used for casual use such as for a beach or a recreation room, or can be used as a serious chair for a sophisticated home or apartment. Also there are many kinds of materials that can be used to make the frame including wood, bent wood, glue laminated wood, plywood, fiberglass, resin, steel, aluminum, and other materials that can be fairly strong while being long and thin. The frame can be made of tubular materials of various shapes including round, square, elliptical, etcetera, as well angled metal, unshaped materials, plastic, vinyl, and other materials known or to be known to those skilled in the art relating to this invention. And it may be preferable to make the frame of different materials, such as making the backrest 2 frame (which could be covered with fabric) out of tubular metal, while the exposed parts could be made out of wood for aesthetic reasons. Additionally, all of the above can be made of various diameters or thicknesses.

Further it is not necessary to make the chair reclining, thus a fixed chair can be made with the principles for stability.

The cross members 2*t*, 2*m*, and 2*b* cross members can be contoured, and especially in a concave manner to make the support sheet 2*s* somewhat concave in a side to side manner to conform to the shape a human body. Further, depending upon the construction, a backrest frame could be made without the middle cross member 2*m*, or possibly the other cross members could be reconfigured.

The cross member between the sides 14 could be installed on the first or base supporting portion between the backrest connection means 6 and the rear supporting portion 8*r*, or potentially even eliminated if the backrest connection means 6 could be made sturdy enough.

The frame can be made of different sizes to accommodate people of different sizes, as well as smaller for use by children. Also, the frame can be made wider for comfort or for multiple users in a manner similar to a love seat—or narrower for compactness.

The concepts shown on various embodiments are interchangeable, for example, the angled armrests shown on FIG. 2A could be used on the embodiment in FIG. 1A, or the curved frame side 2*l* shown in FIG. 2A could be used with the embodiment in FIG. 1A. Likewise, an interlocking or other adjustment mechanism could be used in any of the embodiments. Further, the backrest sides 2*l* and 2*r* can be curved on the upper portion to provide an integral a headrest or essentially a cervical pillow, as is common among ergonomically designed chairs.

Thus the scope of the invention should be determined by the appended claims and their legal equivalents, rather than by the examples given.

I claim:

1. A structure for a legless leisure chair comprising:

(a) a left side and a right side, each comprising:

i. a first portion contacting a supporting surface, said first portion comprising a front supporting portion contacting the supporting surface and a rear supporting portion contacting the supporting surface, wherein the front supporting portion is horizontally disposed from the rear supporting portion;

ii. a generally horizontal second portion vertically disposed from the first portion, and wherein the second portion comprises a front armrest portion and a rear armrest portion, wherein the front armrest portion is generally vertically disposed from the front supporting portion;

iii. a means for holding the second portion vertically disposed from the first portion;

iv. a backrest connection means at an intermediate point between the front supporting portion and the rear supporting portion, wherein said backrest connection means is somewhat above the supporting surface and considerably lower than the generally horizontal second portion;

v. a means for holding the backrest connection means at the intermediate point between the front supporting portion and the rear supporting portion, and somewhat above the supporting surface and considerably lower than the generally horizontal second portion;

vi. a means to maintain the left and right sides in a generally mirror arrangement;

wherein the front armrest portion is a horizontal distance in front of the backrest connection means to provide comfort to the forearm of a person sitting in the chair and the front supporting portion is a horizontal distance in front of the backrest connection means that is at least half the horizontal distance the front armrest portion is in front of the backrest connection means, so that the front supporting portion is in front of the backrest connection means a horizontal distance at least sufficient to prevent instability of the chair when downward force by a person getting out of the chair is exerted on the front armrest portion; and (b) a backrest comprising a top, a bottom, a right frame side, a left frame side, and a support sheet means, wherein the left frame side has a lower connection means and the right frame side has a lower connection means;

wherein the backrest is positioned between said left and right sides, wherein the backrest is at an acute angle in relation to the supporting surface between the backrest connection means and the rear supporting portion, and wherein the backrest left frame side lower connection means is connected to the backrest connection means on the left side, and wherein the backrest right frame side lower connection means is connected to the backrest connection means on the right side.

2. The structure of claim 1, wherein the backrest connection means on the sides are pivotable to enable the backrest to pivot in a manner as to adjust the degree of inclination of the acute angle between the backrest and the support surface, and wherein the lower connection means on the backrest right frame side and the backrest left frame side, each protrude generally forward with a backrest pivoting extension a distance that enables the bottom of the backrest to adjust downward as the degree of inclination of the acute angle is decreased in a manner that helps maintain proper backrest alignment and wherein the backrest connection means are elevated above the support surface a distance greater than the distance the backrest pivoting extension protrudes thereby enabling the bottom of the backrest to pivot substantially freely with regards to the supporting surface.

3. The structure of claim 2, wherein the backrest pivoting extensions protrude generally forward at an angle between about 115° and 155°.

4. The structure of claim 2, wherein the backrest pivoting extensions protrude generally forward at an angle between about 125° and 145°.

5. The structure of claim 1 wherein the backrest connection means are pivotable, wherein there is an adjustable stop behind the backrest, wherein the adjustable stop is pivotally attached to the armrest extensions on left and right sides at an intermediate point between the rear armrest portion and the rear supporting portion, to adjust the degree of inclination of the backrest.

6. The structure of claim 1 wherein a cushioned seat is flexibly attached near the bottom of the backrest, and wherein part of the cushioned seat is generally between the front supporting portion of the left and right sides, and wherein most of the underside of the cushioned seat is contacting the supporting surface.

7. The structure of claim 1 wherein a backrest cushion is on the backrest, and wherein said backrest cushion is of sufficient thickness to cause a person sitting in the chair leaning against the backrest cushion to be moved forward.

8. The structure of claim 1 wherein the rear supporting portion is at least as far behind the backrest connection means as the front supporting portion is in front of the backrest connection means.

9. The structure of claim 1 wherein the backrest connection means is no more than 3" above the supporting surface.

10. The structure of claim 1 wherein the means for holding the second portion vertically disposed from the first portion causes support for the second portion to be transferred to the supporting surface by the first supporting portion, including the front supporting portion and the rear supporting portion.

11. The structure of claim 1 wherein the horizontal distance the front armrest portion is in front of the backrest connection means is at least 40% of the distance that the armrest portion is vertically disposed from the supporting surface SS, and wherein the horizontal distance the front supporting portion is in front of the backrest connection is at least 30% of the distance the armrest portion is vertically disposed from the supporting surface SS.

12. A structure for a legless leisure chair comprising:

(a) a left side and a right side, each comprising:

i. a first portion contacting a supporting surface, said first portion comprising a front supporting portion contacting the supporting surface and a rear supporting portion contacting the supporting surface, wherein the front supporting portion is horizontally disposed from the rear supporting portion; a generally horizontal second portion vertically disposed from the first portion, and wherein the second portion comprises a front armrest portion and a rear armrest portion, wherein the front armrest portion is generally vertically disposed from the front supporting portion;

ii. a means for holding the second portion vertically disposed from the first portion;

iii. a backrest connection means at an intermediate point between the front supporting portion and the rear supporting portion, wherein said backrest connection means is somewhat above the supporting surface and considerably lower than the generally horizontal second portion;

iv. a means for holding the backrest connection means at the intermediate point between the front supporting portion and the rear supporting portion, and somewhat above the supporting surface and considerably lower than the generally horizontal second portion;

v. a means to maintain the left and right sides in a generally mirror arrangement;

wherein the front armrest portion is a horizontal distance in front of the intermediate point between the front supporting portion and the rear supporting portion, wherein the front supporting portion is a horizontal distance in front of the intermediate point that is at least half the horizontal distance the front armrest portion is in front of the intermediate point, whereby the front supporting portion is in front of the intermediate point a horizontal distance at least sufficient to prevent instability of the chair when downward force is exerted on the front armrest portion by a person getting out of the chair; and (b) a backrest comprising a top, a bottom, a right frame side, a left frame side, and a support sheet means, wherein the left frame side has a lower connection means and the right frame side has a lower connection means;

wherein the backrest is positioned between said left and right sides, wherein the backrest is at an acute angle in relation to the supporting surface between the backrest connection means and the rear supporting portion, and wherein the backrest left frame side lower connection means is connected to the backrest connection means on the left side, and wherein the backrest right frame side lower connection means is connected to the backrest connection means on the right side.

13. The structure of claim 12, wherein the backrest connection means on the sides are pivotable to enable the backrest to pivot in a manner as to adjust the degree of inclination of the acute angle between the backrest and the support surface, and wherein the lower connection means on the backrest right frame side and the backrest left frame side, each protrude generally forward with a backrest pivoting extension, in a manner that enables the bottom of the backrest to adjust downward as the degree of inclination of the acute angle is decreased in a manner that helps maintain proper backrest alignment and enabling the bottom of the backrest to pivot substantially freely with regards to the supporting surface.

14. The structure of claim 13, wherein the backrest pivoting extensions protrude generally forward at an angle between about 115° and 155°.

15. The structure of claim 13, wherein the backrest pivoting extensions protrude generally forward at an angle between about 125° and 145°.

16. The structure of claim 12 wherein the backrest connection means are pivotable, wherein there is an adjustable stop behind the backrest, wherein the adjustable stop is pivotally attached to the armrest extensions on left and right sides at an intermediate point between the rear armrest portion and the rear supporting portion, to adjust the degree of inclination of the backrest.

17. The structure of claim 12 wherein a cushioned seat is flexibly attached near the bottom of the backrest, and wherein part of the cushioned seat is generally between the front supporting portion of the left and right sides, and wherein most of the underside of the cushioned seat is contacting the supporting surface.

18. The structure of claim 12 wherein a backrest cushion is on the backrest, and wherein said backrest cushion is of sufficient thickness to cause a person sitting in the chair leaning against the backrest cushion to be moved forward.

19. The structure of claim 12 wherein the rear supporting portion is at least as far behind the backrest connection means as the front supporting portion is in front of the backrest connection means.

20. The structure of claim 12 wherein the backrest connection means is no more than 3" above the supporting surface.

21. The structure of claim 12 wherein the means for holding the second portion vertically disposed from the first portion causes support for the second portion to be transferred to the supporting surface by the front supporting portion and the rear supporting portion.

22. The structure of claim 12 wherein the horizontal distance the front armrest portion is in front of the intermediate point between the front supporting portion and the rear supporting portion is at least 40% of the distance that the front armrest portion is vertically disposed from the supporting surface SS, and wherein the horizontal distance the front supporting portion is in front of the intermediate point between the front supporting portion and the rear supporting portion is at least 30% of the distance the front armrest portion is vertically disposed from the supporting surface SS.

23. A structure for a legless leisure chair comprising:

(a) a left side and a right side, each comprising:

i. a first portion contacting a supporting surface, said first portion comprising a front supporting portion contacting the supporting surface and a rear supporting portion contacting the supporting surface, wherein the front supporting portion is horizontally disposed from the rear supporting portion;

ii. a generally horizontal second portion vertically disposed from the first portion, and wherein the second portion comprises a front armrest portion and a rear armrest portion, wherein the front armrest portion is generally vertically disposed from the front supporting portion;

iii. a means for holding the second portion vertically disposed from the first portion;

iv. a backrest connection means at an intermediate point between the front supporting portion and the rear supporting portion;

v. a means for holding the backrest connection means at the intermediate point between the front supporting portion and the rear supporting portion;

vi. a means to maintain the left and right sides in a generally mirror arrangement;

wherein the front armrest portion is a horizontal distance in front of the backrest connection means and the front supporting portion is a horizontal distance in front of the backrest connection means, wherein the front supporting portion is in front of the backrest connection means a horizontal distance at least sufficient to prevent instability of the chair when at least 80 pounds of downward force is exerted on the front armrest portion, and wherein the rear supporting portion is a horizontal distance in back of the backrest connection means, and wherein the horizontal distance the rear supporting portion is in back of the backrest connection means is at least as great as the horizontal distance the front supporting member is in front of the backrest connection means; and (b) a backrest between the two sides having a top, a bottom, a right frame side, a left frame side, and a support sheet means, wherein the left frame side has a lower connection means and the right frame side has a lower connection means;

wherein the backrest is positioned between said left and right sides, wherein the backrest is at an acute angle in relation to the supporting surface between the backrest connection means and the rear supporting portion, and wherein the backrest left frame side lower connection means is connected to the backrest connection means on the left side, and wherein the backrest right frame side lower connection means is connected to the backrest connection means on the right side.

* * * * *